US005899514A

United States Patent [19]

York et al.

[11] Patent Number: 5,899,514

[45] Date of Patent: May 4, 1999

[54] CARRIER DEVICE

[75] Inventors: Michael T. York, Chelsea; Richard K. Harris, Walled Lake, both of Mich.

[73] Assignee: Progressive Concepts, Inc., Walled Lake, Mich.

[21] Appl. No.: 08/924,874

[22] Filed: Sep. 5, 1997

[51] Int. Cl.[6] ..... A47F 7/08; B65D 71/00

[52] U.S. Cl. ..... 294/146; 294/158; 294/163

[58] Field of Search ..... 294/137, 141–143, 294/145–147, 158, 159, 162–166; 206/315.1, 315.9; 211/14, 34; 224/919; 280/811, 816, 825

[56] References Cited

U.S. PATENT DOCUMENTS

| | | | |
|---|---|---|---|
| 2,592,389 | 4/1952 | Budy | 294/158 X |
| 3,307,759 | 3/1967 | Fulton | 294/147 |
| 3,909,718 | 9/1975 | Allsop et al. . | |
| 4,248,365 | 2/1981 | Jacobs | 294/143 |
| 4,269,337 | 5/1981 | Sobotka | 294/163 |
| 4,277,006 | 7/1981 | Pinckard | 294/145 |
| 4,279,366 | 7/1981 | Kessler et al. | 294/162 |
| 4,331,357 | 5/1982 | Contreras | 294/145 |
| 4,363,514 | 12/1982 | Buffum | 294/162 |
| 4,394,042 | 7/1983 | Smith | 294/163 |
| 5,269,580 | 12/1993 | Hsiao | 294/162 |
| 5,335,956 | 8/1994 | Panossian | 294/146 X |
| 5,611,427 | 3/1997 | Bigham | 206/315.1 |
| 5,617,983 | 4/1997 | Lindauer et al. | 224/433 |
| 5,709,425 | 1/1998 | Cordova | 294/158 X |

FOREIGN PATENT DOCUMENTS

| | | | |
|---|---|---|---|
| 113180 | 2/1918 | United Kingdom | 294/158 |

*Primary Examiner*—Johnny D. Cherry
*Attorney, Agent, or Firm*—Harness, Dickey & Pierce

[57] ABSTRACT

The present invention is directed to an apparatus for carrying in-line skates and accessories. The in-line skates have blades that have at least two adjacent wheels and at least one substantially enclosed opening. The apparatus comprising a continuous plastic molded body consisting of a support structure with an extending member forming a handle. The support structure has a pair of outwardly extending flexible tabs sized to secure a hockey puck or ball between them. On the opposite side of the handle are two outwardly extending flexible extensions that are opposed to each other forming a channel that is sized to tightly fit the shaft of a hockey stick allowing the user to secure a hockey stick to the apparatus. In addition, the support structure includes a first and second vertical member appropriately spaced apart that extend downward from the main body of the support structure and are opposed to each other. A rod is permanently attached to the first vertical member and extends toward the second vertical member on a slightly downward angle ending slightly beyond the second vertical member. The second vertical member's end that is closest to the rod has a cutout shape to allow the diameter of the rod to be snap fit into a cutout in the end of this second vertical member. While in the unsnapped position, the end of the rod can be slid through a substantially enclosed opening on an in-line skate such as the opening between the blade and the boot. The procedure can be repeated with a second in-line skate and then the rod's free end can be snap fit into the second vertical members notched end to securely retain the skates on the rod.

18 Claims, 4 Drawing Sheets

CARRIER DEVICE

BACKGROUND

1. Field Invention

The present invention relates to an apparatus for carrying skates, and more particularly to an apparatus for carrying in-line skates.

2. Description of Prior Art

In-line skating is an extremely popular sport for all ages. Skating is usually done on hard concrete or asphalt surfaces in local parks, cities, or recreational areas. This requires the skates to be transported to locations suitable for this sports activity. The difficult is that in-line skates are bulky and difficult to handle when the user is trying to carry them by hand.

There have been various types of carriers designed in an attempt to make transporting in-line skates more manageable. For example, one device for carrying in-line skates has a main body that has two slots cut out of it that accept either in-line or ice skate blades. Straps are connected to the main body that wrap around the boot of each skate and hold the skate in the described slots. An additional strap is connected to the top of the body to allow the assembly to be carried by one hand of the user. The device further contains hockey stick slots in the main body of the unit that are lined with rubber type material. The rubber material is attached to the sidewalls of the slots in order to interference fit with the hockey stick handles and retain the stick handles in the slots.

The difficulty with such a device is that it is bulky and requires a number or components (three straps, two rubber type liners, and at least five strap connection devices). These components must be assembled onto the main body of the device or onto the ends of the straps or both. This significantly adds to the cost of the unit, making it undesirable for the average skater. Also, the device does not have any ability to hold a hockey puck or street hockey ball. These items are frequently transported at the same time as the skates.

There are also carriers that are configured to transport ice skates. However, ice-skate carriers are typically long and define slots that receive the entire length of the skate blade. Such ice skate carriers are not appropriate for in-line skates since in-line skates have large and bulky blades containing wheels and bearings. A corresponding carrier that is configured to receive the length and width of an in-line skate blade also would be large and bulky. Such a carrier would be heavy, difficult to manage, and defeat the purpose of having a carrier.

Therefore, a compact, lightweight, inexpensive, in-line skate carrier that will also carry a hockey puck or street hockey ball is desired. The present carriers that will accommodate in-line skates do not contain all of these qualities.

OBJECTS AND ADVANTAGES

Accordingly, several objects and advantages of the present invention are:

(a) to provide an in-line skate carrying device that is easy to attach a pair of skates to and easy to detach the skates for use and is convenient to carry;

(b) to provide a carrier that is easy to attach a hockey stick to and easy to detach the hockey stick for use;

(c) to provide a carrier that is easy to attach a hockey puck or street hockey ball to and easy to detach the puck or ball for use;

(d) to provide a carrier that is inexpensive to manufacture in mass production;

(e) to provide a carrier that will carry a pair of skates, hockey stick, and ball or puck and is molded in one piece without the need to add components to the carrier;

(f) to provide a carrier that will carry a pair of skates, hockey stick, and ball or puck in a compact package size that is not bulky to transport;

Further objects and advantages are to provide an in-line skate carrying device which is simple to use and inexpensive to manufacture. The carrier can be easily molded using a simple molding die without the need for any horizontal sliding die members to create off-axis cavities in the carrier. Another object and advantage is that this invention can also be made in a variety of sizes and colors.

Further objects and advantages the present invention will become apparent from a consideration of the drawings and ensuing description.

DRAWING FIGURES

REFERENCE NUMERALS IN DRAWINGS

| | |
|---|---|
| 10 carrier device | 12 handle |
| 14 upper tab | 16 lower tab |
| 18 upper channel hook | 20 lower channel hook |
| 22 left vertical member | 24 right vertical member |
| 26 rod | 28 right snap |
| 30 left snap | 32 stop |
| 34 horizontal member | 36 hinge |
| 38 rod end | 40 hockey puck |
| 42 left skate | 44 right skate |
| 46 ball | 48 right pocket |
| 50 left pocket | 52 right lead |
| 54 left lead | 56 slot |
| 58 blade | 60 left boot |
| 62 right boot | |

SUMMARY

In accordance with the present invention, an in-line skate-carrying device comprises a plastic molded body. The body consists of a curved handle for carrying, two flexible channel hooks used to attach a hockey stick, two additional flexible tabs to attach either a hockey puck or street hockey ball, a three sided support structure comprised of an upper horizontal member and two spaced vertical members extending downward from the horizontal top member, a cylindrical rod integrated as part of one of the vertical members, extending perpendicular from this member and ending beyond the opposed vertical member and sized to snap fit into the slot in the opposed vertical member. The entire assembly is an integral part molded all at the same time in the same mold. The rod is also sized to allow it to be slipped in the slot located between the boot and the blades of in-line skate blades. The rod is snap fit into the vertical member that has a mating slot configured to allow the rod to be snap fit. Therefore, the rod is trapped between the boot and blade of each skate and enclosed on both ends by the opposed two vertical members.

DESCRIPTION OF INVENTION

Figure 1:
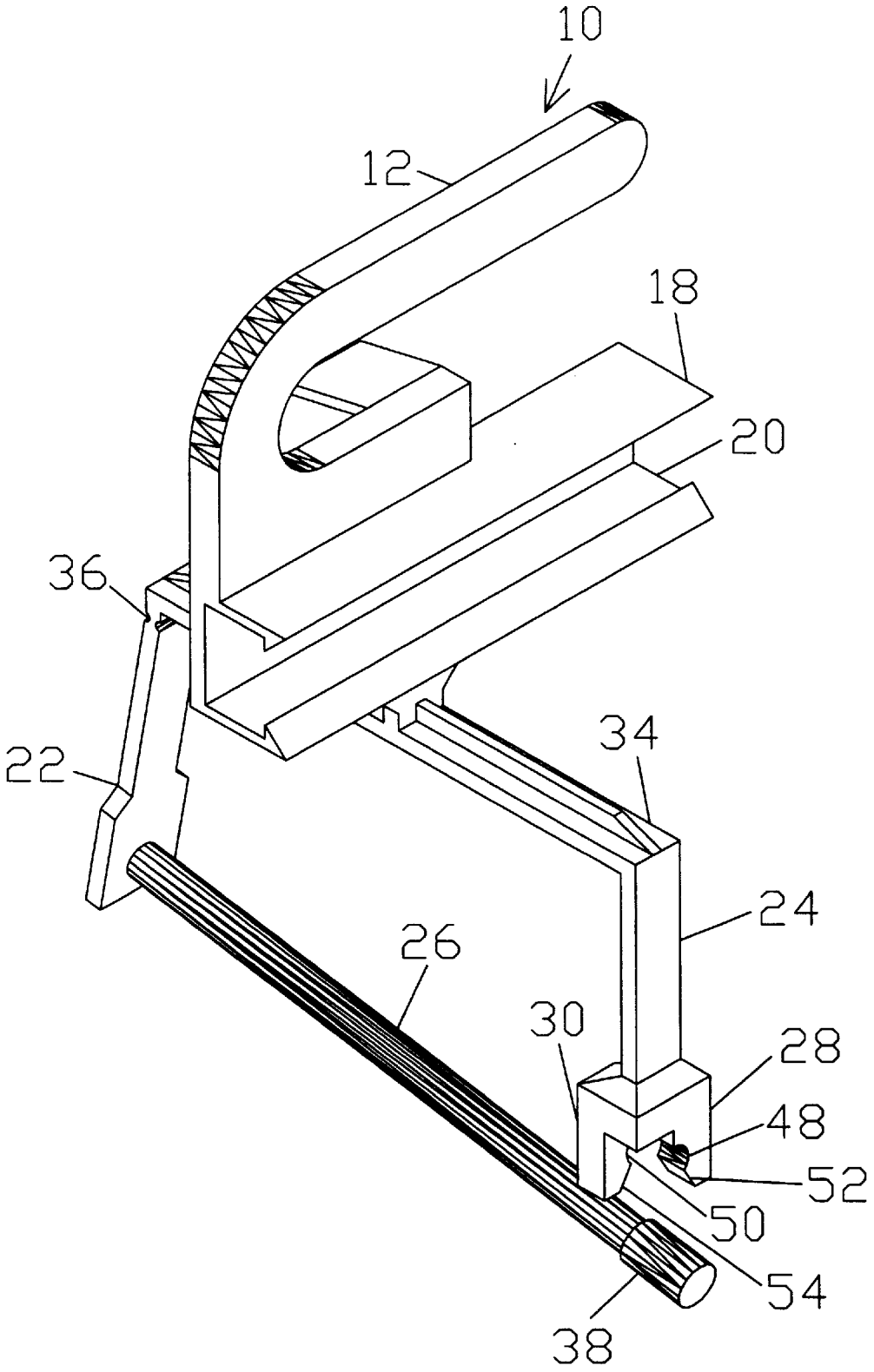
FIG. 1 is a perspective view of the present invention opened.
Figure 2:
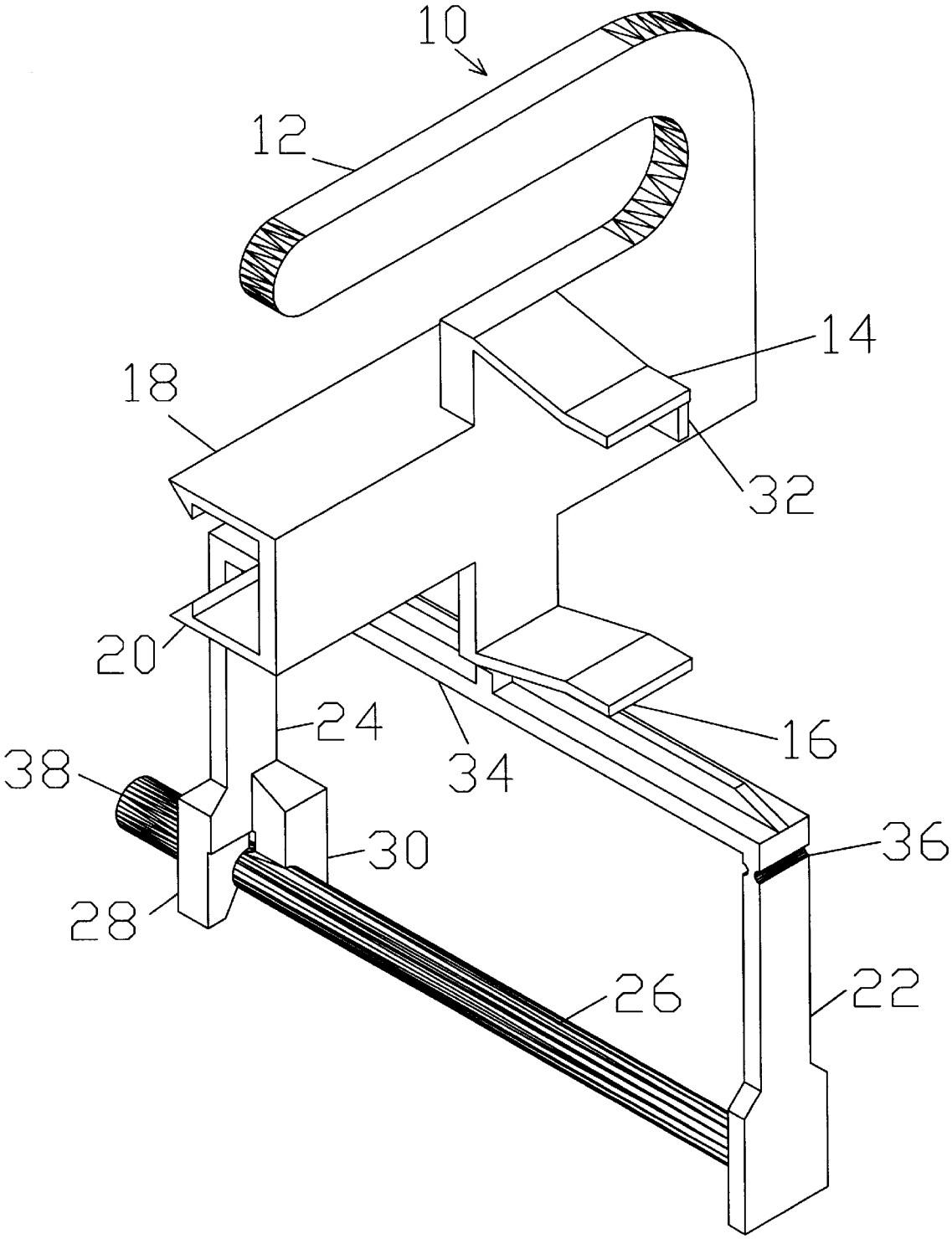
FIG. 2 is a perspective view of the present invention closed without skates, ball, or puck shown.

FIGS. 1 and 2 show an overall view of the present invention, an in-line skate carrier device 10 comprised of a continuous molded body. The body is made up of a handle 12 that is formed at the top of the device. FIG. 2 shows an upper tab 14 and a lower tab 16 projecting outwardly from either side of handle 12 to form a pair of opposed flexible tabs. The tabs are shaped with thin long flexible section walls that have sufficient stiffness as to provide a clamping force between the upper and lower tabs when an object is forced between them causing the tabs to deflect. The tab walls protrude from the sidewall of the handle on an angle such that the upper and lower tabs diverge toward each other as they extend from the side of handle 12. They continue along this constant angle for approximately 1.25 inches and then their angle changes such that the further extension of the tab wall is perpendicular to the sidewalls of handle 12. A solid plastic rectangular shape puck stop 32 also projects outwardly from the same side of handle 12 as the upper and lower tabs; it is vertically centered between them and horizontally offset to one side of the area between the upper and lower tabs. On the opposite side of handle 12 an upper channel hook 18 and a lower channel hook 20 both extend outward to form a pair of opposed flexible channels. The upper and lower channels are shaped to have thin long sections that are flexible and end in a hook shaped geometry.

The bottom of handle 12 ends by connecting to the center of a horizontal member 34 that extends outwardly perpendicular and beyond the side walls of handle 12 on each side an equal distance. The horizontal member has a T shaped cross-section to provide enhanced mechanical stiffness and prevent the ends of this member from bending down when a pair of skates 42, 44 are being carried on a rod 26. All of these components are integrally attached to form skate carrier 10, made of a suitable plastic material with sufficient mechanical properties.

FIG. 1 shows a left vertical member 22 extending downwardly from one end of horizontal member 34 and a right vertical member 24 extending downwardly from the opposite end of the horizontal member. The left vertical member has a living hinge 36 near the intersection of horizontal member 34 and left vertical member 22. The living hinge consists of a well-known geometry; it is created in the plastic of the inside and outside walls of the left vertical member which allows left vertical member 22 to pivot about the center of hinge 36. Rod 26 extends outwardly from either side of vertical member 22 and extends in the direction of vertical member 24. A rod end 38 that extends for a short length at the end of rod 26 has a larger diameter than that of rod 26. A right snap 28 and a left snap 30 are both connected to the end of right vertical member 24. Right snap 28 has an inner surface that has a radius cut out, which forms a right pocket 48 that is sized to match the diameter of rod 26. Left snap 30 also has an identical radius cut out, which forms a left pocket 50 that is also sized to match the diameter of rod 26. The right and left pockets 48 and 50 are opposed to each other and laterally offset as shown. All of these components are integrally attached to form skate carrier 10, molded in one piece and made of a suitable plastic material with sufficient mechanical properties.

Figure 3:
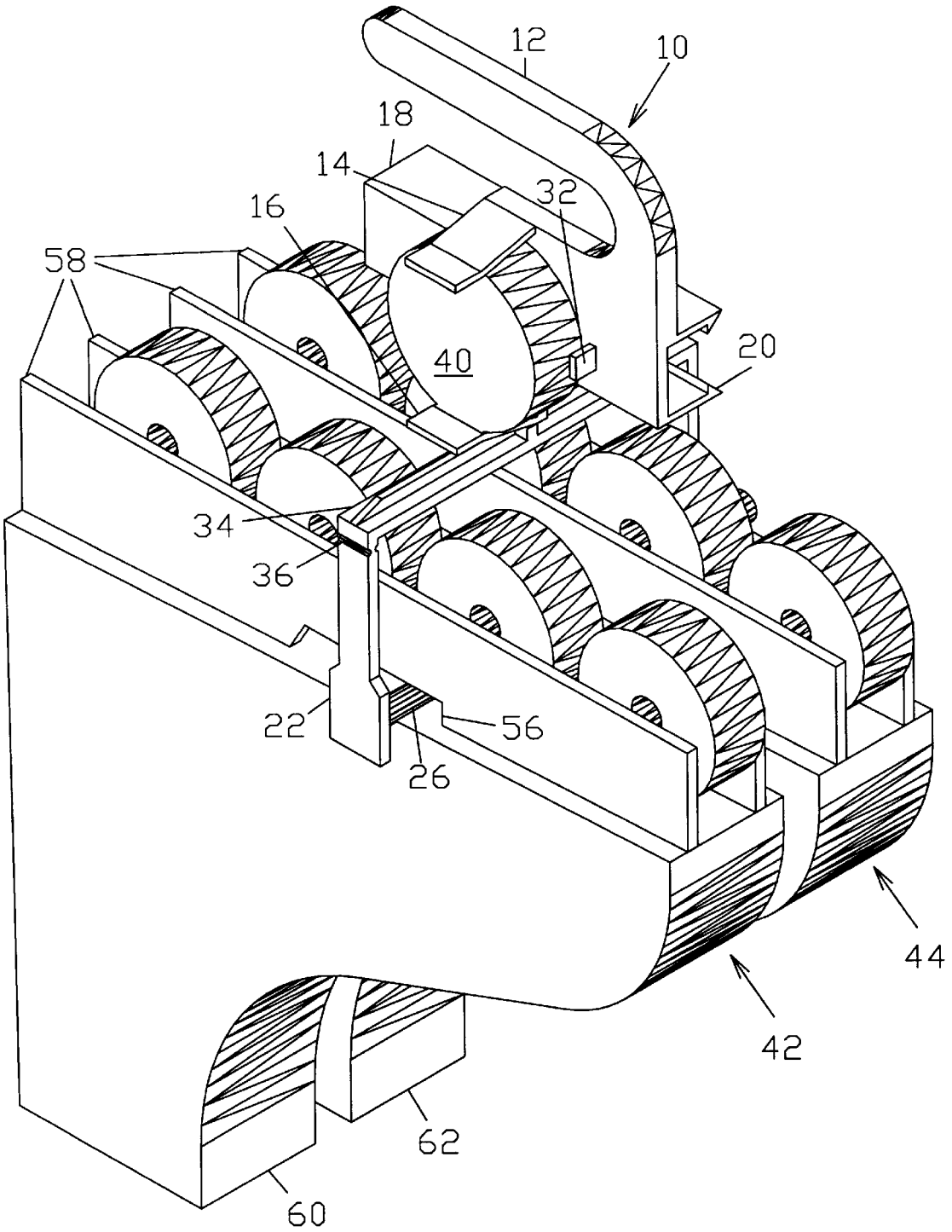
FIG. 3 is an overall view of the present invention in the closed position assembled with in-line skates, and a hockey puck.

FIG. 3 shows a perspective view of the present invention with rod 26 fit through a pair of slots 56 on skates 42 and 44. The rod is trapped in slots 56 by a pair of blades 58 and a pair of boots 60 and 62. Rod 26 is snapped into right and left snaps 28 and 30 as shown in FIG. 2. In this way the blades of the skates are trapped between the left and right vertical members 22 and 24 and rod 26. A hockey puck 40 is snap fit into upper and lower tabs 14 and 16. The puck is pushed up against puck stop 32 as shown in FIG. 2.

Figure 4:
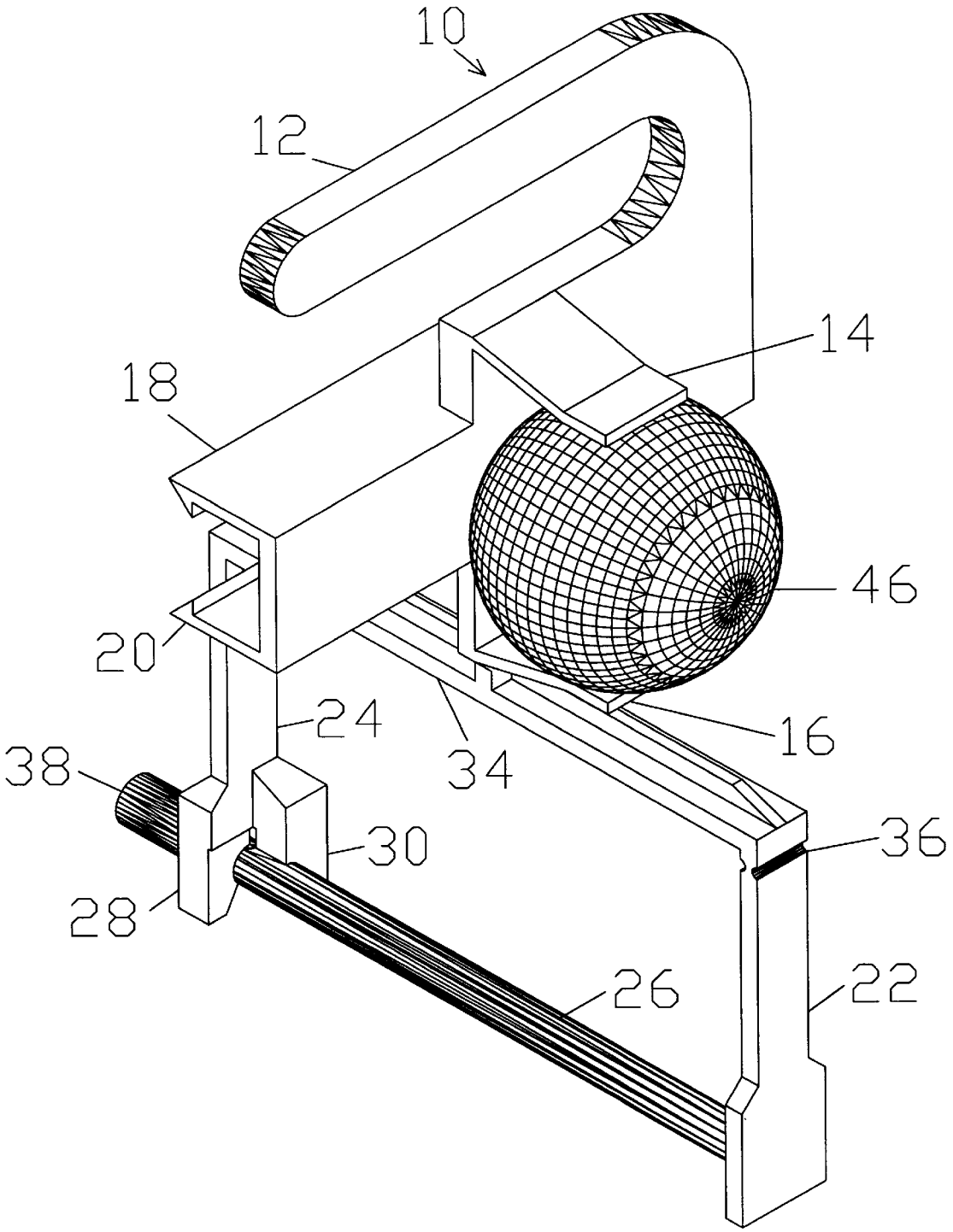
FIG. 4 is a perspective view of the present invention closed without skates shown and a ball attached.

FIG. 4 is a perspective view showing a street hockey ball 46 snap fit into upper and lower tabs 14 and 16 instead of hockey puck 40 as shown in FIG. 3.

Operation—FIGS. 1,2,3,4

In-line skate carrier device 10 is used to transport and store in-line skates 42 and 44, hockey puck 40, ball 46, and a hockey stick (not shown). Handle 12 is shaped to allow the user to pick up the in-line skate carrier device with one hand and carry it on one side of the user's body. The handle is also shaped to allow the carrier device to be hung on a hook or pin that outwardly extends from a wall.

FIG. 2 shows upper and lower tabs 14 and 16 that are made of the same flexible plastic material as the rest of the carrier device. The tabs are shaped to enable the user to snap fit between the tabs either hockey puck 40 or ball 46 as shown in FIGS. 3 and 4. The tabs exert a clamping force on the puck or ball holding them between the tabs on carrier device 10.

FIG. 1 shows upper channel hook 18, and lower channel hook 20 extending from the opposite side of handle 12. The channel they form between them is shaped to accommodate the shaft of a hockey stick. The channel hooks have a thin section extending from the side of handle 12 and a hook shape at the end of the extensions. The thin sections of the channels are designed to flex outward when the user manually force-fits the hockey stick shaft into the channel. Once the hockey stick shaft is completely forced into the channel, it clears the hooks and they snap down to retain the hockey stick in place on the carrier device by preventing the stick from falling out of the channel.

Horizontal member 34, shown in FIG. 1 is a support beam used to support left and right vertical members 22 and 24. The left and right vertical members are used to support rod 26 when the rod is snapped into right and left snaps 28 and 30. The left vertical member has living hinge 36 molded into it near the connection point between the horizontal member and the left vertical member. The hinge is composed completely of the plastic material used to mold the rest of the carrier device and is comprised of a unique but well known geometry that allows the plastic to bend at the center of the hinge many times without breaking. Hinge 36 allows the rotation about the center of the hinge of left vertical member 22. This allows rod 26 to be easily snapped into and out of right and left snaps 28 and 30. The right and left snaps flex outwardly when the user begins to force rod 26 into the snaps, a right lead 52, and a left lead 54 assist this process. Once rod 26 is fully in place the right and left snaps capture the diameter of the rod and therefore retain the rod in position. The right and left snaps 28 and 30 are laterally offset to allow their geometry to be molded in a simple molding die without the need for slides since the geometry can be completely created by the combination of the two halves of the die. This reduces manufacturing cost of the molding dies and production cycle times.

The user of the carrier device will find it convenient and easy to use by following the below-described procedure. In FIG. 1 carrier device 10 is shown in the open position (rod 26 is not snapped into the right and left snaps). The user will grasp handle 12 with one hand and pick up the unit. With the other hand the user will grasp one in-line skate 42 and turn the skate upside down. With the wheels of the skate pointing upward the user can position the carrier device such that rod end 38 is pointing at slot 56 in blade 58 on skate 42. Next the user will slide the skate toward left vertical member 22 so that rod end 38 slides through slot 56 and both blades 58 of the skate. The procedure is then repeated using the second skate 44 so that rod 26 protrudes through both of the slots in each skate. The carrier device will then be tilted on an angle such that rod end 38 points upward to prevent either of the skates from sliding back off of the rod. The user will then grasp protruding rod end 38 with the hand that was used to slide the skates on and force fit rod 26 into right and left snaps 28 and 30 using right and left leads 52 and 54 to assist in aligning the rod. The rod will snap into position with right and left pockets 48 and 50 snap fit around the outer diameter of the rod and will hold the rod in position as shown in FIG. 3. In this position the carrier device can be carried with either of the user's hands on either side of the body without concern that the skates will fall off since the rod is snap fit into position. In addition to carrying the skates, the user may elect to carry a hockey stick (not shown) by holding the handle of the carrier device in one hand and forcing the shaft of the hockey stick in between the upper and lower channel hooks 18 and 20 as previously described using the other hand. Also, hockey puck 40 or street hockey ball 46 can be carried by the user force fitting either component in between the flexible upper and lower tabs 14 and 16 as described above.

The function of the components making up the skates will not be described since in-line skating is extremely popular and the function of the components shown is common to nearly all in-line skates.

SUMMARY, RAMIFICATIONS, AND SCOPE

Accordingly, the reader will see that the carrier device of this invention can be easily and conveniently used to carry in-line skates, and can also be used to carry a hockey stick, ball, or puck just as easily. In addition, this invention permits simple and rapid detachment of the in-line skates, a hockey stick, ball and puck. Furthermore, this invention has the additional advantages in that (a) it can be made as a simple one piece plastic molded part that is inexpensive to manufacture, not requiring any assembly of separate components;

(b) it provides a simple, easy to use, carrier device that can assemble a pair of in-line skates, hockey stick, and ball or puck in a compact organized manner that is not bulky to transport or store;

(c) it provides a design that can be manufactured using inexpensive molding dies that do not have any off-axis mold slides to form geometries that the main two halves of the molding die cannot form due to die lock;

(d) it permits the entire carrier to be molded out of a common, inexpensive, plastic (for example, polypropylene) greatly reducing the material cost as compared with current art designs;

(e) it utilizes a simple, low cost, living hinge geometry to enable the in-line skates to be easily attached and detached to the carrier device;

(f) it provides an extremely lightweight design that is easy to carry;

(g) it provides an in-line carrier device that allows secure attachment of the skates, hockey stick, puck or ball;

Although the description above contains much specificity, these should not be construed as limiting the scope of the invention but as merely providing illustrations of some of the presently preferred embodiments of this invention. For example, the carrier device could be made from a number of other shapes, such as the horizontal member could be one or more angles instead of being flat and horizontal as shown; the one piece construction could be replaced by a number of separate components attached together by some method of attachment such as adhesives; the living hinge could be eliminated or replaced by a more traditional style of hinge; the handle could be replaced by a simple cutout in the body of the carrier device; the entire assembly or parts of the assembly could be made to a different size or in different proportions to each other; it could be made of a different material other than plastic; it can be made in a wide variety of colors; the flexible tabs that hold the puck could be replaced by a slot; the upper and lower channel hooks for retaining the hockey stick shaft could be replaced by simpler walls without hooks; the rod could be replaced with another style beam or a strap; the horizontal member and left and right vertical members could be replaced by a single U shaped member with or without a living hinge; the left and right snap could be replaced with another type of snap geometry or attaching method like a hook and loop fastener; the tabs and channel hook designs used to hold a hockey puck or ball and a hockey stick could be eliminated, etc.

Thus the scope of the invention should be determined by the appended claims and their legal equivalents, rather than by the examples given.

We claim:

1. An apparatus for carrying skates, each skate comprising a boot, a blade and a substantially enclosed opening, said apparatus comprising a handle connected to a support structure, said support structure comprising a body portion and first and second spaced apart downwardly depending side members terminating in lower ends, a mounting member fixed to the lower end of the first side member and extending to the second side member and attaching means for releasably attaching the mounting member to the lower end of the second side member whereby the mounting member can be inserted through the enclosed opening in the skates when the mounting member is released from the second side member and the mounting member subsequently attached to the second side member to secure the skates to the apparatus.

2. The apparatus of claim 1 wherein said handle, and said support structure are formed as one piece.

3. The apparatus of claim 1 wherein said support structure includes a living hinge coupling the first side member to the support structure.

4. The apparatus of claim 1 wherein the first side member is rotatably coupled to the body portion.

5. The apparatus of claim 4 wherein the mounting member is substantially rigid.

6. The apparatus of claim 1 further comprising a securing means connected to said support structure for holding a hockey stick to said support structure.

7. The apparatus of claim 6 wherein said securing means for holding said hockey stick is a channel.

8. The apparatus of claim 1 further comprising a securing means connected to said support structure for holding a hockey ball to said support structure.

9. apparatus of claim 8 wherein said securing means for holding said hockey ball is a pair of opposed flexible tabs extending from said support structure.

10. The apparatus of claim 1 further comprising a securing means connected to said support structure for holding a hockey puck to said support structure.

11. The apparatus of claim 10 wherein said securing means for holding said hockey puck is a pair of opposed flexible tabs extending from said support structure.

12. The apparatus of claim 1 wherein said attaching means securing said in-line skates to said support structure is detachably connected on at least snap engages the mounting member to attach the mounting member to the second side member.

13. The apparatus of claim is 12 wherein the mounting member attaches to the second side member upon upward movement of the mounting member into engagement with the lower end of the second side member.

14. The apparatus of claim 1 further comprising a securing means for holding a hockey stick and a securing means for holding a hockey ball to said support structure.

15. An apparatus for carrying skates, each skate comprising a boot, a blade and a substantially enclosed opening, said apparatus comprising a handle, a support structure including first and second spaced apart downwardly depending side members terminating in lower ends, a mounting member fixed to the lower end of the first side member and extending to the second side member and attaching means for releasably attaching the mounting member to the lower end of the second side member whereby the mounting member can be inserted through the enclosed opening in the skates when the mounting member is released from the second side member and the mounting member subsequently attached to the second side member to secure the skates to the apparatus, said handle, said support structure, said mounting member and said attaching means all being formed as a one piece plastic molded unit.

16. An apparatus for carrying skates, each skate comprising a boot, a blade and a substantially enclosed opening, said apparatus comprising a support structure, a mounting member coupled to the support structure, said mounting member having first and second ends, said first end of said mounting member being fixed to said support structure, said support structure further having means for releasably coupling said second end of said mounting member to said support structure, means for releasably mounting a hockey stick to said support structure and means for releasably mounting a hockey puck or hockey ball to said support structure.

17. The apparatus of claim 16 wherein said support structure, said mounting member, said means for releasably coupling said second end of said mounting member to said support structure, said means for releasably mounting a hockey stick to said support structure and said means for releasably mounting a hockey puck or hockey ball to said support structure are formed as a single piece.

18. The apparatus of claim 16 wherein said support structure, said mounting member, said means for releasably coupling said second end of said mounting member to said support structure, said means for releasably mounting a hockey stick to said support structure and said means for releasably mounting a hockey puck or hockey ball to said support structure are formed as a single piece of molded plastic.

* * * * *